US006755222B2

(12) United States Patent
Kondo et al.

(10) Patent No.: US 6,755,222 B2
(45) Date of Patent: Jun. 29, 2004

(54) LIQUID FILLING METHOD

(75) Inventors: Masakatsu Kondo, Tokushima (JP); Michio Ueda, Tokushima (JP)

(73) Assignee: Shikoku Kakoki Co., Ltd., Tokushima (JP)

( * ) Notice: Subject to any disclaimer, the term of this patent is extended or adjusted under 35 U.S.C. 154(b) by 0 days.

(21) Appl. No.: 10/240,732

(22) PCT Filed: Feb. 15, 2001

(86) PCT No.: PCT/JP01/01078

§ 371 (c)(1),
(2), (4) Date: Oct. 9, 2002

(87) PCT Pub. No.: WO01/76945

PCT Pub. Date: Oct. 18, 2001

(65) Prior Publication Data

US 2003/0047235 A1 Mar. 13, 2003

(30) Foreign Application Priority Data

Apr. 10, 2000 (JP) ..... 2000-108545

(51) Int. Cl.[7] ..... B65B 1/04
(52) U.S. Cl. ..... 141/129; 141/172; 141/275
(58) Field of Search ..... 141/84, 148–152, 141/172, 177, 253, 257, 266, 275, 276–278, 129, 144, 168

(56) References Cited

U.S. PATENT DOCUMENTS 2,849,033 A * 8/1958 Nalbach ..... 141/148
3,335,767 A * 8/1967 Manas ..... 141/147
5,195,565 A * 3/1993 Owen et al. ..... 141/148
5,758,698 A * 6/1998 Kaneko ..... 141/263

FOREIGN PATENT DOCUMENTS

| | | |
|---|---|---|
| JP | 53-74981 | 7/1978 |
| JP | 6-345007 | 12/1994 |
| JP | 8-85592 | 4/1996 |

* cited by examiner

*Primary Examiner*—Steven O. Douglas
(74) *Attorney, Agent, or Firm*—Westerman, Hattori, Daniels & Adrian, LLP

(57) ABSTRACT

The present invention provides a liquid filling method capable of filling liquid into containers at a rate as high as 3500 containers/nozzle·hour (2 pitch-feed) without causing the problems such as foaming, turbulence of liquid surface and the like inside the container, and a high-speed liquid filling machine used in said method. In said method, liquid is filled into a container that had been intermittently carried in a sequential manner to a filling station by raising and lowering said container, the filling is started when the container is raised before it reaches the upper dead point of raising and lowering, the container is filled with a specified amount of liquid at the upper dead point of raising and lowering, and then filling is continued while lowering the container. It is preferable for the filling to be started before the carrying of the container is stopped, for example, the start of the filling to be advanced 30° to 70° from the upper dead point of raising and lowering in one raising and lowering cycle of 360°. Furthermore, it is preferable for the carrying to be started before the lowering of the container is finished, wherein the start of carrying the container is advanced 40° to 70° from the end of lowering in one raising and lowering cycle of 360°.

21 Claims, 6 Drawing Sheets

LIQUID FILLING METHOD

FIELD OF THE INVENTION

The present invention relates to a liquid filling method capable of filling liquid such as juice, milk and the like into containers at a rate of as high as 3500 container/nozzle·hour (2-pitch feed), and a high-speed liquid filling machine used in said method.

DESCRIPTION OF THE RELATED ART

Hitherto, a high-speed liquid filling machine provided with a filling station as shown in FIG. 1, for example, has been known as a high-speed liquid filling machine for filling liquid such as milk, juice and the like into paper containers. Said high-speed liquid filling machine is provided with a machine frame 1 which has a filling station, a carrying conveyor 2 capable of carrying a container such that it is sequentially stopped at the filling station, a rotative body 4 having a radial mandrel 3 which is disposed upward of the starting end of the carrying route of said carrying conveyor 2, a filling apparatus 8 having a filling tank 5, a quantifying cylinder 6 and a filling nozzle 7 and a container raising-lowering apparatus 9 which are disposed at the filling station in the midpoint of the carrying route, a heat-sealer 10 disposed at the latter half of the carrying route, and the like.

The filling and packing by using the high-speed liquid filling machine mentioned above comprises the steps of: first, a container material (carton blank) is retrieved while spreading into a tetragonal cylinder shape from a magazine 11 which retains a container material capable of forming into a tetragonal cylinder shape and is sequentially inserted to a mandrel 3, then the end portion which is to become the bottom of the container is heated by a bottom heating apparatus 12, the end portion around the container which had been heated is evenly interfolded by a container end portion interfolding apparatus 13, the aforementioned end portion which had been evenly interfolded is pressed and made to a tetragonal cylinder shaped container with a bottom by a container bottom pressing apparatus 14, and said tetragonal cylinder shaped container with a bottom is transferred from the mandrel to a container holder attached to a chain 15. The aforementioned carrying conveyor 2 is comprised of a chain 15 that is linked with said multiple container holders and a pair of sprockets 16 and 17 that is each provided at the starting end and finishing end of the carrying route which the chain 15 is bridged.

The tetragonal cylinder shaped container with a bottom, which had been transferred to the carrying conveyor, is intermittently carried above a rail 18 that takes and guides the bottom of the container by the container holder attached to chain 15. Said container reaches the filling station via a preparatory interfolding apparatus 19 that puts a crease so that the top portion of the tetragonal cylinder shaped container with a bottom can easily be interfolded into a roof-shape, and a sterilizing apparatus 20 that sterilizes the interior of the container by spraying hydrogen peroxide solution and/or ultraviolet irradiation. After the tetragonal cylinder shaped container with a bottom which is intermittently carried and stops at the filling station is pushed up by the container raising-lowering apparatus 9 and reaches the upper dead point, the filling of liquid from the filling nozzle 7 is started. The filling while lowering continues until the tip of the filling nozzle 7 comes off from the container by the lowering of the container, and carrying of the container is started almost at the same time as the completion of the filling. The tetragonal cylinder shaped container with a bottom in which liquid had been filled passes through a main interfolding apparatus 21 that eventually interfolds the top portion of the container which a crease had been put to a roof-shape, and through a container top portion heating apparatus 22 that heats the sealed surface of the top portion of the container which had been interfolded, and the top portion of the container is heat-sealed by a heat-sealer 10 that presses the top portion of the container, followed by printing of the date or the like by a printing apparatus 23, and is discharged as a product of a package filled with liquid.

To date, in a filling method of liquid such as milk, juice or the like into paper containers that had been carried by an intermittently driving conveyor and stops sequentially at the filling station by using the aforementioned high-speed liquid filling apparatus, a method had been adopted wherein filling is started from the filling nozzle where its tip is adjacent to the bottom of the container, at the time the container is pushed up by the container raising-lowering apparatus and reaches the upper dead point, and filling is conducted while lowering the container so that the liquid filled does not contact the tip of the tip of the filling nozzle, in order to prevent foaming, spattering and shaking of the liquid. Further, the maximum flow rate of the filling could be reduced in order to prevent foaming, spattering, and shaking of liquid effectively, which occur when filling liquid into a paper container. Since it is necessary to make the fill time as long as possible in order to reduce the maximum flow rate of the filling when the filling amount is constant, filling was continued also when the tip of the filling nozzle is withdrawn from the container in the above-mentioned conventional manner of filling only during the lowering of the container. In such case, the distance between the tip of the nozzle and the fill level became large, causing problems such as foaming of the liquid, and the sealed surface which is heat-sealed after the filling being contaminated due to spattering of the liquid.

Further, as a result of extending the fill time, the timing for draining in the filling nozzle became slow, and the liquid was adhered to the sealed surface, and the liquid surface immediately after the filling became unstable, causing a problem which had a bad effect on high-speed filling due to the shaking of liquid or the like when carrying. In addition, since the filling at the point it reaches the upper dead point starts where the container is empty, the distance between the tip portion of the nozzle and the bottom of the container is set to an adjacent distance of 5 to 10 mm in view of the spattering and foaming, and therefore, the filling amount near the upper dead point cannot be increased. Therefore, the maximum flow rate for filling had to be increased in order for the filling to be conducted within a given period of time, which often caused foaming, spattering, and shaking of liquid. Extending the fill time can be considered in order to improve said situation of filling. However, in that case, the time for lowering the container becomes long, causing the time the intermittently carrying conveyor is stopped to become longer, inevitably making the transport time of the conveyor shortened when speed up is planned. Consequently, the shaking of liquid becomes harder as the acceleration flow rate when transporting increases, and there was a concern that the sealed surface would be contaminated and cause seal defection.

DISCLOSURE OF THE INVENTION

Planning of the speed up of machine is concerned in order to improve the filling capability in a filling machine. The more the speed up is planned, the more the operation cycle of the machine becomes shorter, thereby making the fill time required for one container shorter, and liquid corresponding to the inside capacity of the container is filled within a limited time of about one second, and is necessary to carry to the next process. In order to do so, the discharge flow rate during the filling has to be increased, however, increasing the flow rate generates foaming, spattering, and shaking of liquid. The filling capability is determined according to the generation of said foaming, spattering, and shaking of liquid, and to date, it could not exceed 3000 containers/nozzle·hour (2-pitch feed). An object of the present invention is to provide a liquid filling method capable of filling liquid at a rate of as high as 3500 containers/nozzle·hour (2-pitch feed) without causing problems such as foaming and turbulence of liquid surface inside the containers and a high-speed liquid filling machine used in said method.

The inventors of the present invention have conducted an intensive study to elucidate the object mentioned above, and have discovered that high-speed filling can be conducted by the following: filling is started when the container is raised before it reaches the upper dead point of raising and lowering, the distance between the tip portion of the nozzle and the bottom of the container is made greater, the container is filled with a specified amount of liquid at the upper dead point of raising and lowering, and then filling is continued while lowering the container. The inventors also discovered that without having to increase the filling flow rate, and, particularly by finishing the filling before withdrawal of the nozzle from the container when filling into a container having a head space, the generation of foaming, spattering, and shaking of liquid can be suppressed. Thus, the present invention had been completed.

More specifically, the present invention relates to a liquid filling method wherein said method is a method of filling liquid into a container while raising and lowering said container, where filling is started when the container is raised before it reaches an upper dead point of raising and lowering, the container is filled with a specified amount of liquid at the upper dead point of raising and lowering, and then filling is continued while lowering the container (claim 1), the liquid filling method according to claim 1, wherein a container is intermittently carried sequentially to a filling station (claim 2), the liquid filling method according to claim 1 or 2, wherein filling is continued from the start of the filling to the end of the filling (claim 3), the liquid filling method according to any of claims 1 to 3, wherein the start of filling is advanced 1° to 90° from an upper dead point of raising and lowering in one raising and lowering cycle of 360° (claim 4), the liquid filling method according to any of claims 1 to 4, wherein the distance between a tip of a filling nozzle and a bottom of a container is 20 mm to 70 mm in an upper dead point of raising and lowering (claim 5), the liquid filling method according to any of claims 1 to 5, wherein the distance between a liquid surface inside a container and a tip portion of a nozzle is 1 mm to 15 mm when filling in the lowering movement (claim 6), the liquid filling method according to any of claims 2 to 6, wherein filling is started before the carrying of a container is stopped (claim 7), the liquid filling method according to any of claims 2 to 7, wherein the start of raising a container is advanced 20° to 50° from the stopping of carrying in one carrying cycle of 360° (claim 8), the liquid filling method according to any of claims 2 to 8, wherein carrying is started before the lowering of a container is finished (claim 9), the liquid filling method according to any of claims 2 to 9, wherein the start of carrying of a container is advanced 40° to 70° from the end of lowering in one raising and lowering cycle of 360° (claim 10).

Moreover, the present invention relates to a high-speed liquid filling machine wherein said machine is provided with a carrying conveyor capable of carrying a container such that it stops sequentially at a filling station and a filling apparatus and a container raising-lowering apparatus disposed in the filling station, where said machine is provided with a controlling means capable of controlling such that filling is started when the container is raised before it reaches the upper dead point of raising and lowering, the container is filled with a specified amount of liquid at the upper dead point of raising and lowering, and then filling is continued while lowering the container (claim 11), the high-speed liquid filling machine according to claim 11, wherein the filling apparatus is provided with a filling nozzle disposed upward to the carrying route of a container, a quantifying cylinder which has a built-in piston and sends liquid to a filling nozzle by reciprocation of said piston, and an independent driving mechanism which reciprocates said piston at a random amount of stroke and/or a random speed of stroke (claim 12), the high-speed liquid filling machine according to claims 11 or 12, wherein the controlling means is capable of controlling such that filling is continued from the start of the filling to the end of the filling (claim 13), the high-speed liquid filling machine according to any of claims 11 to 13, wherein the controlling means is capable of controlling such that the start of the filling is advanced 1° to 90° from an upper dead point of raising and lowering in one raising and lowering cycle of 360° (claim 14), the high-speed liquid filling machine according to any of claims 11 to 14, wherein the controlling means is capable of controlling such that the distance between a tip of a filling nozzle and a bottom of a container is 20 mm to 70 mm in an upper dead point of raising and lowering (claim 15), the high-speed liquid filling machine according to any of claims 11 to 15, wherein the controlling means is capable of controlling such that the distance between a liquid surface inside the container and a tip portion of the nozzle is 1 mm to 15 mm when filling in the lowering movement (claim 16), the high-speed liquid filling machine according to any of claims 11 to 16, wherein the controlling means is a means capable of controlling such that filling is started before the carrying of a container is stopped (claim 17)., the high-speed liquid filling machine according to any of claims 11 to 17, wherein the controlling means is a means capable of controlling such that the start of raising a container is advanced 20° to 50° from the stopping of carrying in one carrying cycle of 360° (claim 18), the high-speed liquid filling machine according to any of claims 11 to 18, wherein the controlling means is a means capable of controlling such that the carrying is started before the lowering of a container is finished (claim 19), the high-speed liquid filling machine according to any of claims 11 to 19, wherein the controlling means is a means capable of controlling such that the start of carrying the container is advanced 40° to 70° from the end of lowering in one raising and lowering cycle of 360° (claim 20), and the high-speed liquid filling machine according to any of claims 11 to 20, wherein the control by the controlling means is conducted by changing the setting pulse of a servomotor (claim 21).

DETAILED DESCRIPTION OF THE PREFERRED EMBODIMENTS

The liquid filling method according to the present invention is a method wherein liquid is filled into a container while raising and lowering the container. The container has to be raised and lowered in an upward and downward direction, however, the upward and downward direction in said raising and lowering is not limited to an upward and downward direction in a vertical direction. Further, there is no particular limitation to the movement of the filling nozzle to an upward and downward direction in the filling apparatus, however, it is preferable to raise and lower only the container and have the filling nozzle fixed, since the relative distance between the filling nozzle and the container should be set appropriately. In addition, as a container applicable to the filling method according to the present invention, there is no particular limitation to its size, shape or the like, as long as it can be raised and lowered by a raising and lowering means. However, a container which has a tetragonal cylinder shape with a bottom before the filling of liquid, which is filled in from an opening with a clearance with the head space remained, and after the filling, heat-sealed in a situation where its upper portion is interfolded in a roof-shape, can be given as a specific example.

Figure 1:
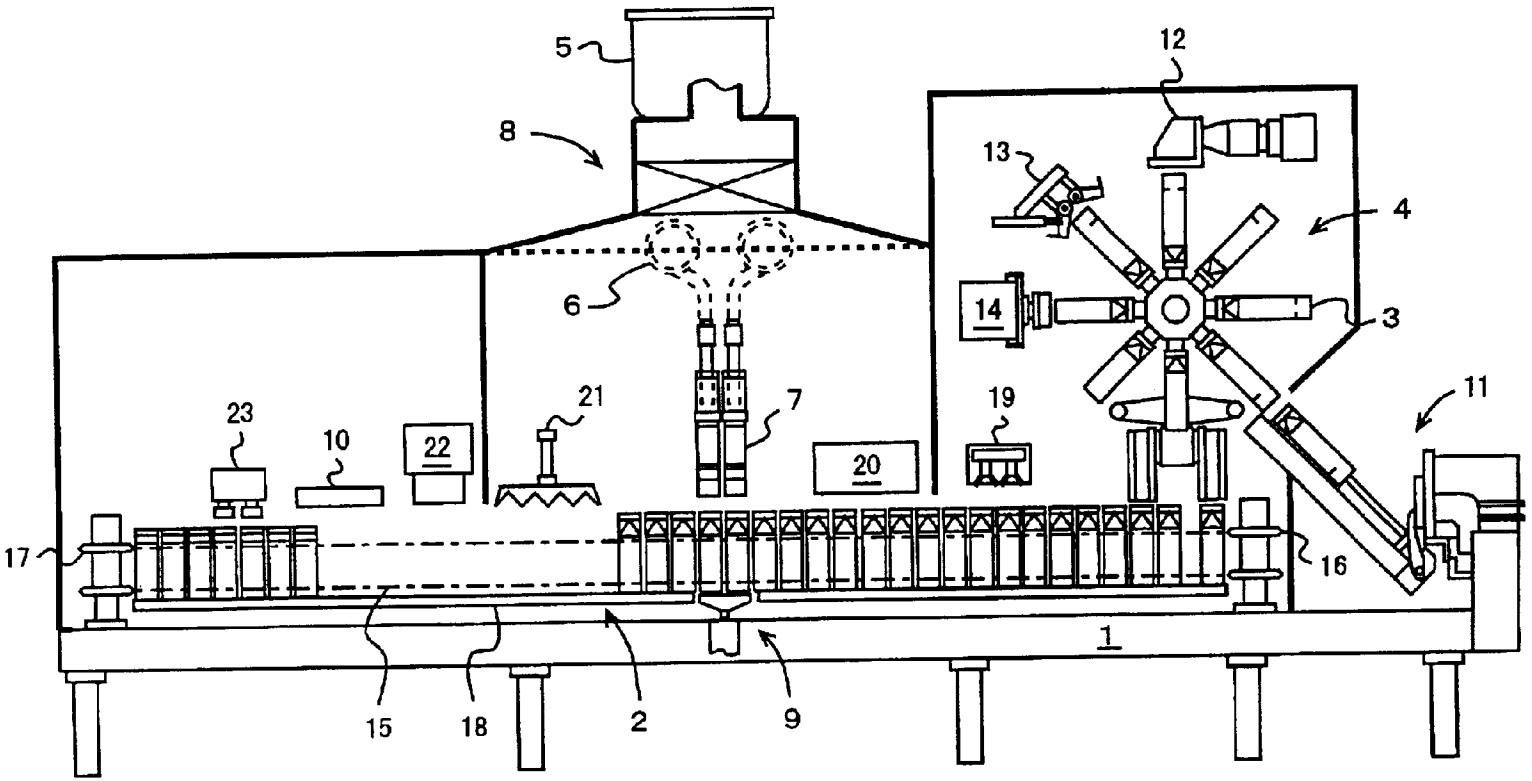
FIG. 1 is a view describing a conventional high-speed liquid filling machine for filling liquid such as milk, juice and the like into paper containers.
Figure 2:
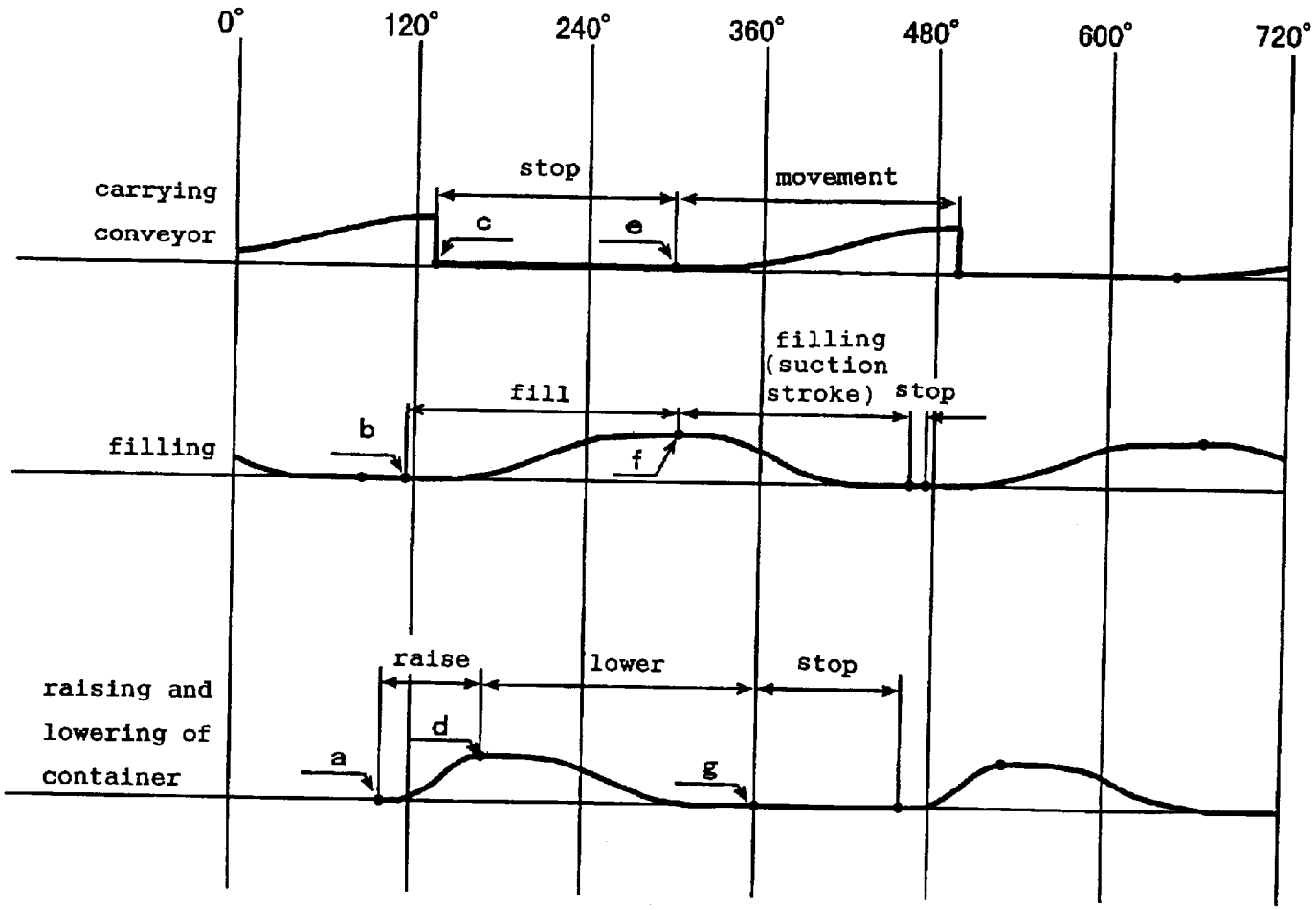
FIG. 2 is a view indicating a timing diagram of the carrying conveyor, the filling, and the raising and lowering of container in the liquid filling method according to the present invention.

The filling method according to the present invention is characterized in that the filling is started when the container is raised before it reaches the upper dead point of raising and lowering. However, there is no particular limitation to the start of the filling as long as the filling is started when the container is raised before it reaches the upper dead point of raising and lowering. It is preferable for the start of the filling to be advanced 1° to 90°, preferably 5° to 85°, and more preferably 30° to 70° from the upper dead point of raising and lowering in one raising and lowering cycle (from the time the raising and lowering is started to the next time the raising and lowering is started, for example) of 360° (see FIG. 2, "timing diagram"). In this way, advancing the timing to start the filling enables to set the fill time to be longer, thereby reducing the maximum flow rate for filling and minimizing the shaking of liquid surface and generation of foaming when filling. Further, in the filling method of the present invention, the filling of liquid from the filling nozzle to each container is preferable to be a continuous filling from the start of the filling to the end of the filling, that is, to continuously discharge the liquid steadily though there is a change in the flow rate of discharging from the start of the filling to the end of the filling, in that it enables the filling to be conducted in a faster flow rate.

As the filling method of the present invention that starts the filling when said container is raised of said container is capable of conducting a high-speed filling, it is particularly advantageous when a serial production method is applied, wherein the container is intermittently carried in a sequential manner to a filling station and filled sequentially, then sequentially heat-sealed. In a case where there is a clearance between the opening for filling of the container and the filling nozzle, the fill time for discharging the liquid can be made longer when the filling is started before the carrying of the container is stopped. In view of ensuring the fill time mentioned above, it is preferable to make the start of raising the container to be advanced about 20° to 50° from the stopping of the carrying in one carrying cycle (from the start of the carrying to the next start of the carrying in an intermittent carrying, for example) of 360° (see FIG. 2). However, in a case where a long fill time for filling is not required, the raising of the container can be started after the carrying of the container is stopped, and the filling can also be started when the container is raised before it reaches the upper dead point of raising and lowering.

As described above, in the filling method according to the present invention, the filling is started when the container is raised before it reaches the upper dead point of raising and lowering, and the container is filled with a specified amount of liquid at the upper dead point of raising and lowering. The amount to be filled at the upper dead point of raising and lowering can conveniently be set according to the size of the container and types of liquid, but the amount to be filled is little compared to that of when lowering, and it is preferable to have the filling in a degree where the collision of the liquid and the bottom of the container when lowering the container is mitigated. In view of the suppression of generation of foaming, spattering, and shaking of-liquid, it is preferable to set the filling amount in the upper dead point of raising and lowering such that the distance between the tip of the filling nozzle and the bottom of the container in the upper dead point of raising and lowering to be 20 mm to 70 mm, preferably 30 mm to 50 mm, and the distance between the filling nozzle and the liquid surface to be 1 mm to 15 mm, preferably 5 mm to 10 mm. According to the filling method according to the present invention wherein the filling is started when the container is raised before it reaches the upper dead point of raising and lowering, the small amount of liquid that had already been filled in the upper dead point of raising and lowering acts as a buffer and suppresses the foaming, spattering and shaking of liquid, thereby enabling to increase the discharge flow rate at once.

In the conventional filling method where the filling is started from the upper dead point of raising and lowering, the filling is started where the container is empty, and in view of the generation of spattering, the filling amount cannot be increased rapidly at near the upper dead point. Since rapid filling is conducted after that in a limited period of time, foaming, spattering and shaking of the liquid during this process are generated. When the fill time is extended to improve said foaming, spattering and shaking of liquid, the time for moving the carrying conveyor becomes short because the time for stopping the carrying conveyor becomes longer. As a result, the accelerated flow rate when moving is increased, causing seal defection because the shaking of liquid inside the container after the filling becomes harder, and eventually, the foaming, spattering, and shaking of liquid as just described were problems for high-speed production.

In the filling method according to the present invention, the filling is started when the container is raised before it reaches the upper dead point of raising and lowering, and then the filling is conducted while lowering the container. Since it is possible to effectively suppress the generation of foaming, spattering and shaking of the liquid within a specified fill time, it is preferable for the distance between the liquid surface inside the container and the tip portion of the nozzle when filling while lowering to be 1 mm to 15 mm, preferably 5 mm to 10 mm.

In a case where there is a clearance between the opening for filling of the container and the filling nozzle, the shaking of liquid when starting the carrying after the filling is finished can be mitigated by starting the carrying before the lowering of the container is finished. For example, it is preferable to start the carrying of the container advanced about 40° to 70° from the end of lowering in one raising and lowering cycle (from the start of raising to the next start of raising, for example) of 360° (see FIG. 2). In order to suppress the shaking of liquid due to the carrying immediately after the filling in an intermittently driving paper container filling machine, the carrying time has only to be extended, however, if the carrying time is extended, then the time for stopping will have to be shortened. In the present invention, measure to shaking of liquid without decreasing the capability is made possible by starting the filling when the container is raised. In a case where the fill time does not have to be long, the carrying of the container can be started after the container is filled and the lowering of the container is finished. to a container having a head space, it is preferable to set the container such that the nozzle withdraws from the container after the filling is finished, for example, such that after the filling is finished, the lowering is finished about 40° to 70° later in one raising and lowering cycle of 360°. In this way, in the filling method of the present invention, the distance between the liquid surface inside the container and the tip portion of the nozzle during the filling downward can be maintained at 1 mm to 15 mm until the filling is finished. Since the tip of the nozzle is positioned near the liquid surface inside the container also after the filling is finished, not only the generation of foaming, spattering, and shaking of liquid is effectively suppressed but also the sealed surface is kept from being contaminated by liquid dripping or the like of the liquid.

On the contrary, in the conventional filling method, filling is continued also while the nozzle is withdrawn from the container, in need to take a long fill time to suppress the maximum flow rate for filling. This caused the generation of foaming, spattering and shaking of liquid due to filling in a condition where the distance between the tip of the nozzle and the liquid surface inside the container has become long. Further, when withdrawing the nozzle from the container, it was configured such that the inside of the nozzle is depressurized by a chuck valve to forcibly refrain the stringiness and dripping of liquid at the end of the filling, in order to prevent the contamination of the sealed surface due to the dripping of the liquid or the like.

The filling method of the present invention is suitably implemented by a high-speed liquid filling machine according to the present invention. The high-speed liquid filling machine according to the present invention, which is a high-speed liquid filling machine equipped with a carrying conveyor capable of carrying a container such that the container sequentially stops at the filling station, and a filling apparatus and a container raising-lowering apparatus disposed in the filling station, there is no particular limitation to the filling machine as long as it is provided with a controlling means capable of controlling such that the filling is started when the container is raised before it reaches the upper dead end point of raising and lowering, the container is filled with a specified amount of liquid at the upper dead point of raising and lowering, and then filling is conducted while lowering the container. Aside from the controlling means, a liquid filling machine equipped with each conventional apparatus publicly known as previously described can be used. However, it is preferable for the filling apparatus in said high-speed liquid filling machine to be provided with a filling nozzle disposed upward of the container carrying route, a quantifying cylinder that has a built-in piston wherein the liquid is sent to the filling nozzle by reciprocation of the piston, and an individual driving mechanism that reciprocates the piston mentioned above at a random amount of stroke and/or a random speed of stroke.

Figure 3:
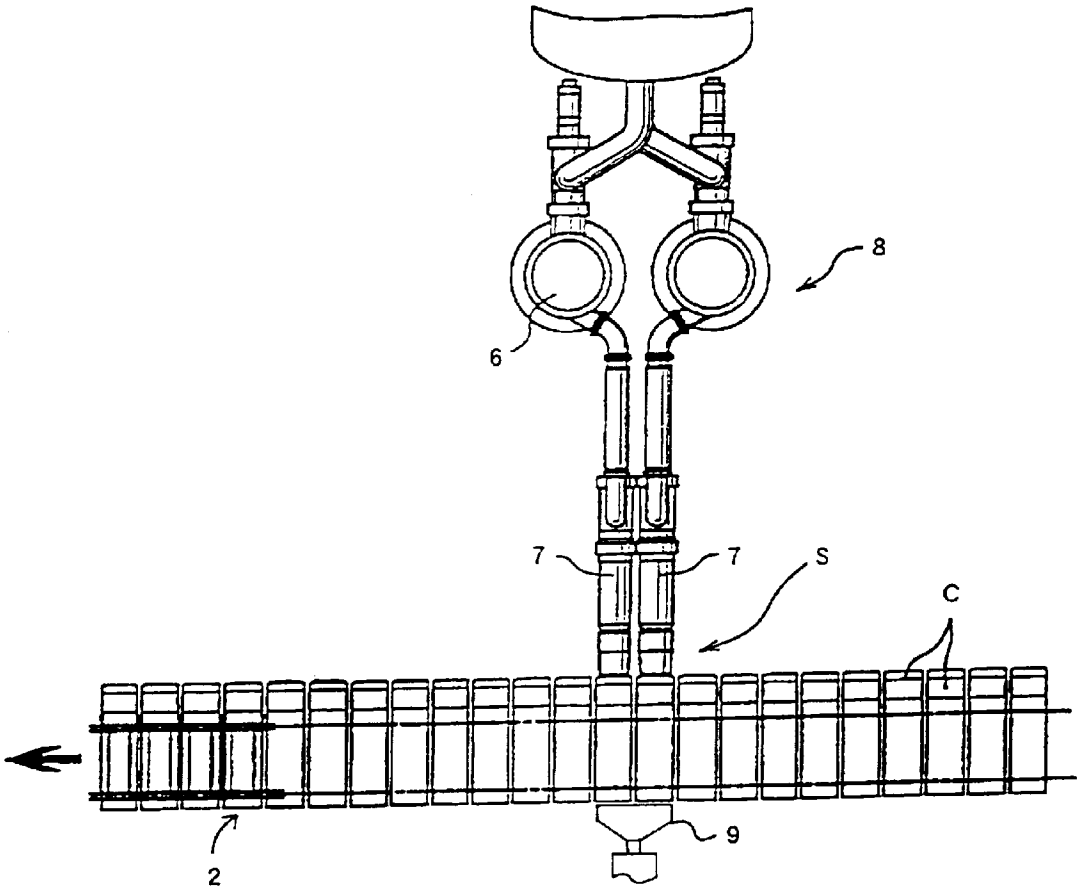
FIG. 3 is a view describing the high-speed liquid filling machine used in the liquid filling method according to the present invention.

FIG. 3 shows a high-speed liquid filling machine wherein said machine is equipped with a carrying conveyor 2 that is capable of carrying a tetragonal cylinder shaped paper container with a bottom C such that the container C is sequentially stopped at the filling station S, and a filling apparatus 8 and a container raising-lowering apparatus 9 disposed in the filling station S, and container C in twos are sequentially carried two pitches at a time, by the action of one cycle of said carrying conveyor 2 that intermittently drives, and container C in twos are carried to the filling station S at the same time and stopped. The filling apparatus 8 mentioned above is equipped with two filling nozzle 7*s* disposed upward of the container carrying route in a filling station S such that it can correspond to two container Cs, two quantifying cylinder 6*s* that has a built-in piston where each quantified amount of liquid is sent to the filling nozzle 7 by the reciprocation of said piston, and an independent driving mechanism which reciprocates the aforementioned piston at a random amount of stroke and/or a random speed of stroke, and all of these have the same structure.

Figure 4:
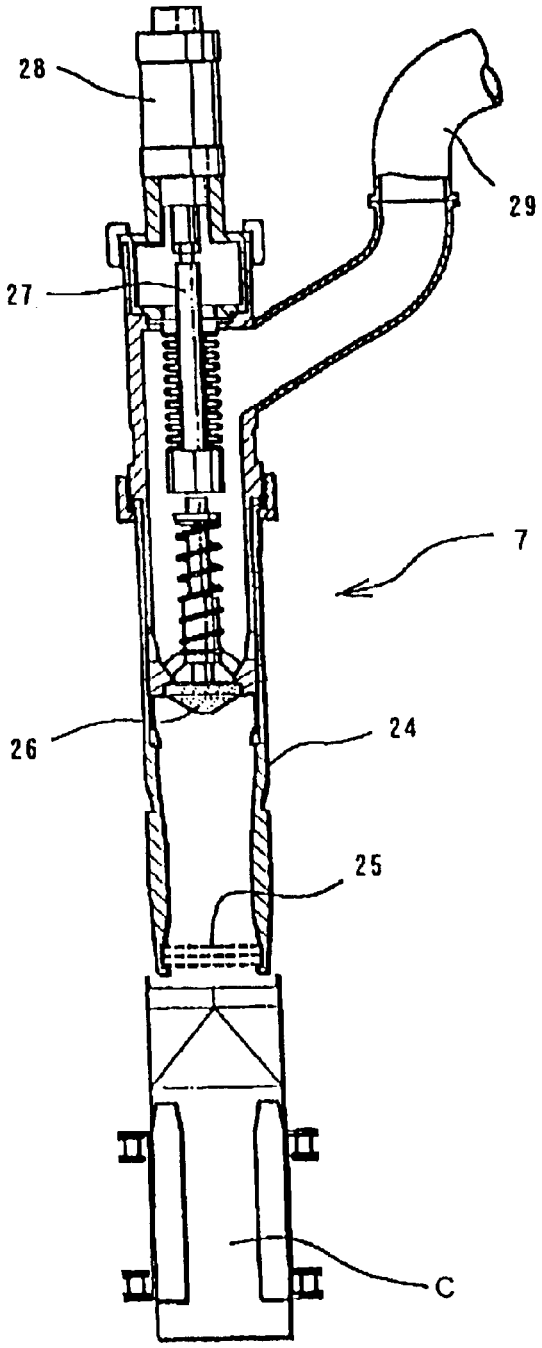
FIG. 4 is a perpendicular longitudinal section view of a filling nozzle in the high-speed liquid filling machine shown in FIG. 3.

FIG. 4 shows that a vertical tetragonal nozzle body 24, a strainer 25 provided at the lower end opening of the nozzle body 24 to prevent the liquid from flowing downwards by its own weight, an outflow check valve 26 provided at the midpoint of the height of the nozzle body 24, and a valve-opening fluid pressure cylinder 28 having a piston rod 27 that is attached at the upper end of the nozzle body 24 vertically in a downward direction and contacts with a valve bar of the check valve 26 to push and move the check valve 26 in a releasing manner when washing or the like. A filling nozzle 7 that is connected to a quantifying cylinder 6 by a connecting duct 29 is also shown.

Figure 5:
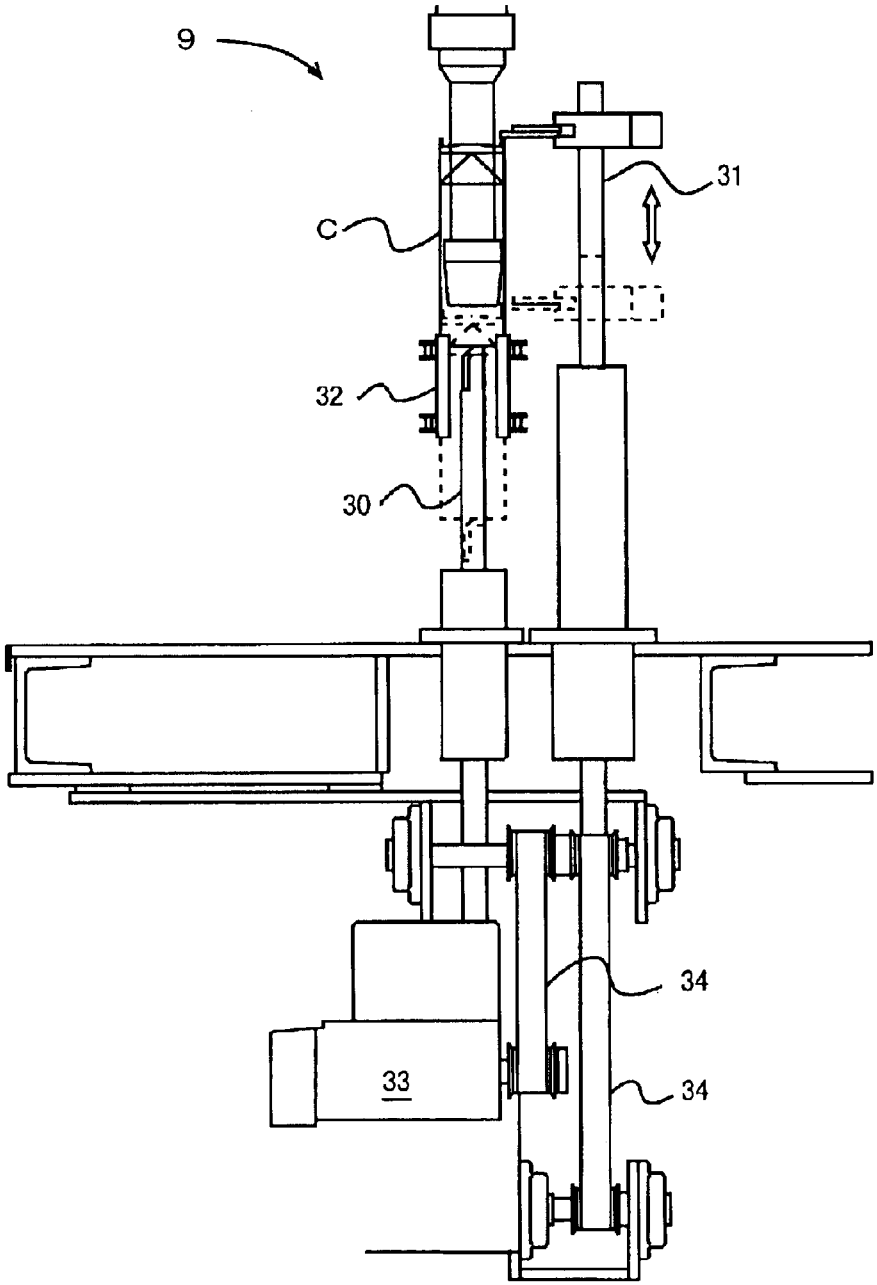
FIG. 5 is a perpendicular longitudinal section view of a container raising-lowering apparatus in the high-speed liquid filling machine shown in FIG. 3.

FIG. 5 indicates a container raising-lowering apparatus 9 provided with a boost-up rod 30 for boosting the container C from the conveyor 2, a depression rod 31 for depressing the container C, and a conveyor holder 32 to stabilize the container C when raising and lowering the container C by the boost-up rod 30 and depression rod 31. The boost-up rod 30 and depression rod 31 are controlled by a timing belt 34, which is driven by a servomotor 33 disposed downward of the boost-up rod 30 and depression rod 31. As described above, in the filling method according to the present invention, the distance between the tip of the filling nozzle and the bottom of the container in the upper dead point of raising and lowering is set and controlled to be 20 mm to 70 mm, preferably 30 mm to 50 mm, so that the filling is started when the container is raised before it reaches the upper dead point of raising and lowering, and to make the container filled with a specified amount of liquid at the upper dead point of raising and lowering. This distance of 20 mm to 70 mm is 10 mm to 65 mm larger compared to the distance of the conventional filling method where filling is started from the upper dead point of raising and lowering. Since the distance the container is raised can be shortened in the present invention, the raising is completed with the container being retained in the conveyor holder, and the container being stuck or the like can be reduced.

The carrying conveyor 2, filling apparatus 8, container raising-lowering apparatus 9 and the like mentioned above are each publicly known. However, the high-speed liquid filling machine according to the present invention, as shown in the timing diagram described in FIG. 2, for example, is provided with a controlling means capable of controlling these mutual operations. Specific examples of these controlling means are: a means wherein a setting pulse of a servomotor which is a driving source of the carrying conveyor 2 mentioned above is changed by a specified timing pattern, and controls the timing, carrying flow rate, carrying distance and the like of the start and end of carrying in the intermittent driving of the conveyor 2; a means wherein a setting pulse of a servomotor which is a driving source of a built-in piston of the quantifying cylinder 6 mentioned above is changed by a specified timing pattern, and controls the timing, amount of strokes and flow rate of strokes when starting and stopping the reciprocation in a piston reciprocation; and a means wherein a setting pulse of a servomotor which is a driving source of the container raising-lowering apparatus 9 mentioned above is changed by a specified timing pattern, and controls the timing, amount of strokes and flow rate of strokes when starting and stopping the raising and lowering of the boost-up rod 30 and depression rod 31 of the container raising-lowering apparatus 9 via the timing belt 34.

Providing the controlling means mentioned above enables the following: to control such that the filling is continued from the start of the filling to the end of the filling; to control such that the start of the filling is advanced 1° to 90°, preferably 5° to 85°, more preferably 30° to 70° from the upper dead point of raising and lowering in one raising and lowering cycle of 360°; to control such that the distance between the tip of the filling nozzle and the bottom of the container in the upper dead point of raising and lowering is 20 mm to 70 mm, preferably 30 mm to 50 mm; to control such that the distance between the liquid surface inside the container and the tip portion of the nozzle when filling by lowering is 1 mm to 15 mm; to control such that the filling is started before the carrying of the container is stopped; to control such that the start of raising the container is advanced 20° to 50° from the stop of the carrying in one carrying cycle of 360°; to control such that the carrying is started before the lowering of the container is finished; and to control such that the start of carrying the container is advanced 40° to 70° from the end of lowering in one raising and lowering cycle of 360°.

Figure 6:
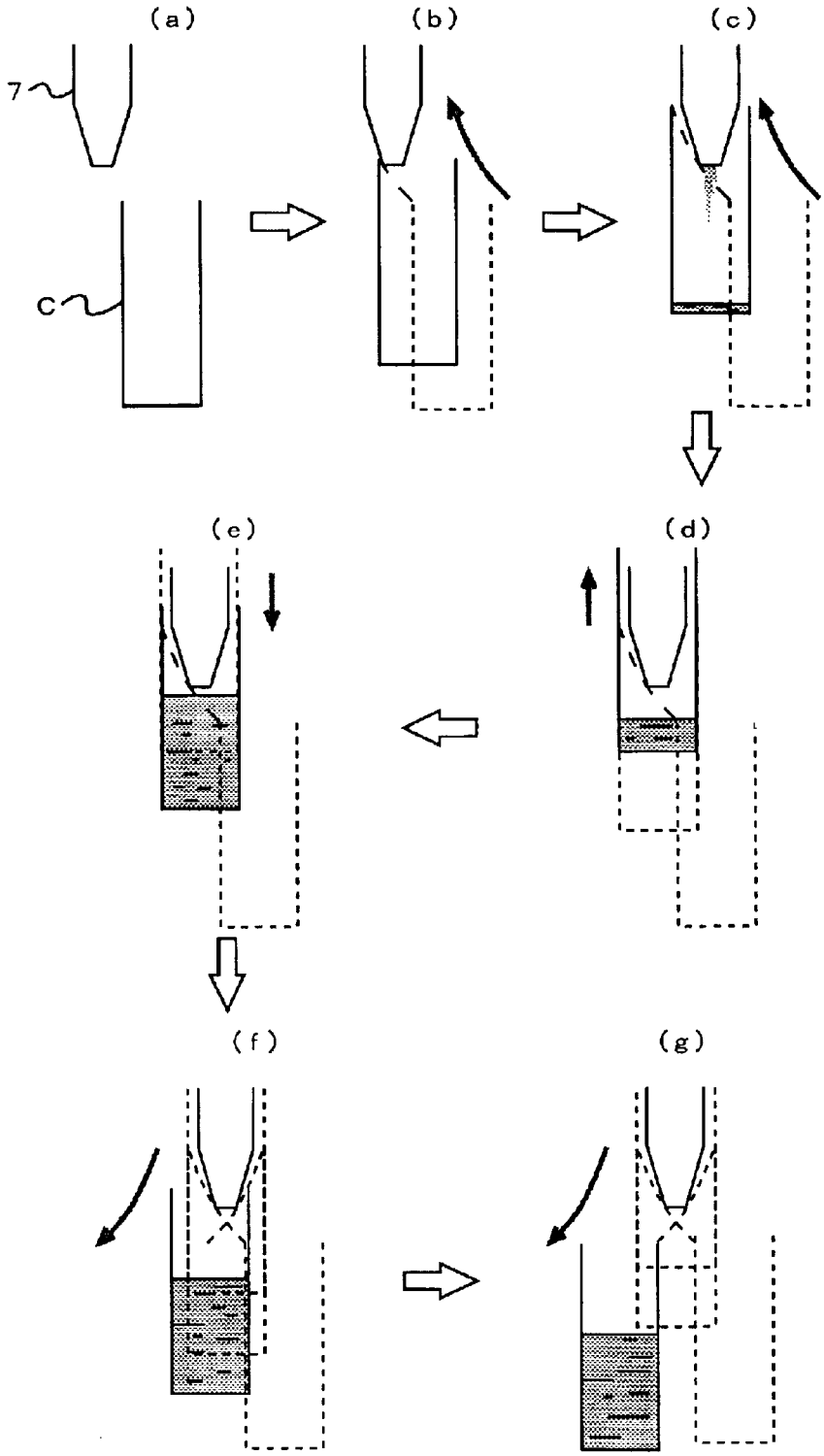
FIG. 6 is a view in a frame format showing the movement of the container during the filling by the liquid filling method according to the present invention.

FIG. 6 describes the movement of the container from the start of raising to the end of lowering by using the controlling means mentioned above, in the positional relationship with the filling nozzle. Further, FIGS. 6*a* to 6*g* correspond with a to g in the timing diagram of FIG. 2. FIG. 6*a* shows the point where the raising of the container is started (the container being carried); FIG. 6*b* shows the point where the filling into the container is started (the container being raised and carried); FIG. 6*c* shows the point where the carrying of the container is stopped (when filling into the container that is being raised), FIG. 6*d* shows the point where the raising of the container is stopped and the lowering of the container is started (upper dead point, when filling into the container); FIG. 6*e* shows the point the carrying of the container is started (when filling into the container that is being lowered); FIG. 6*f* shows the point where the filling into the container is finished (when the container is being lowered and carried); and FIG. 6*g* shows the point where the lowering is finished (container being carried).

In addition, as a substitute for the servomotor as a driving and controlling sources of the above-mentioned filling apparatus, the container raising-lowering apparatus and the like, other driving and controlling sources can also be used. For example, any motor that is operated by a pulse from a controlling apparatus such as a pulse motor can be used. Further, motors aside from that mentioned above are also made possible to be used by providing a detecting means that detects the rotation angle of the motor, the amount of piston movement and the like. Aside from these, as mentioned above, in a case where long fill time is not required, it can also be controlled such that the filling into the container and the raising and lowering of the container are conducted only while the carrying of the container is stopped.

INDUSTRIAL APPLICABILITY

According to the present invention, high-speed filling can be achieved. For example, in a filling machine which is 2-pitch fed and is in 2 lines, the conventional production ability of 3000 containers/nozzle·hour can be made to 3500 containers/nozzle·hour. In addition, according to the present invention, there is little adhesion of liquid to the filling nozzle, the foaming, spattering, and shaking of liquid can effectively be suppressed, and can reduce seal defection due to foaming, spattering and shaking of liquid. Moreover, since the contamination of sealed surface due to the dripping of the liquid and the like was reduced, seal defection caused by this was reduced. Furthermore, seal defection due to shaking of liquid when moving on the conveyor can be reduced. In addition, since the container is not from the conveyor holder when the container is raised, problems related to the draw-in of the container in the machine such as the container being blocked, stuck or the like were no longer generated.

What is claimed is:

1. A liquid filling method wherein said method is a method of filling liquid into a container while raising and lowering said container and having a filling nozzle fixed, where filling is started when the container is raised before it reaches an upper dead point of raising and lowering, the container is filled with a specified amount of liquid at the upper dead point of raising and lowering, and then filling is continued while lowering the container.

2. The liquid filling method according to claim 1,, wherein a container is intermittently carried sequentially to a filling station.

3. The liquid filling method according to claim 1, or 2, wherein filling is continued from the start of the filling to the end of the filling.

4. The liquid filling method according to claim 1, or 2, wherein the start of filling is advanced 1° to 90° from an upper dead point of raising and lowering in one raising and lowering cycle of 360°.

5. The liquid filling method according to claim 1, or 2, wherein the distance between a tip of a filling nozzle and a bottom of a container is 20 mm to 70 mm in an upper dead point of raising and lowering.

6. The liquid filling method according to claim 1, or 2, wherein the distance between a liquid surface inside a container and a tip portion of a nozzle is 1 mm to 15 mm when filling in the lowering movement.

7. The liquid filling method according to claim 2, wherein filling is started before the carrying of a container is stopped.

8. The liquid filling method according to claim 2, wherein the start of raising a container is advanced 20° to 50° from the stopping of carrying in one carrying cycle of 360°.

9. The liquid filling method according to claim 2, wherein carrying is started before the lowering of a container is finished.

10. The liquid filling method according to claim 2, wherein the start of carrying of a container is advanced 40° to 70° from the end of lowering in one raising and lowering cycle of 360°.

11. A high-speed liquid filling machine wherein said machine is provided with a carrying conveyor capable of carrying a container such that it stops sequentially at a filling station and a filling apparatus having a filling nozzle fixed and a container raising-lowering apparatus disposed in the filling station, where said machine is provided with a controlling means capable of controlling such that filling is started when the container is raised before it reaches the upper dead point of raising and lowering, the container is filled with a specified amount of liquid at the upper dead point of raising and lowering, and then filling is continued while lowering the container.

12. The high-speed liquid filling machine according to claim 1,1, wherein the filling apparatus is provided with a filling nozzle disposed upward to the carrying route of a container, a quantifying cylinder which has a built-in piston and sends liquid to a filling nozzle by reciprocation of said piston, and an independent driving mechanism which reciprocates said piston at a random amount of stroke and/or a random speed of stroke.

13. The high-speed liquid filling machine according to claims 11 or 12, wherein the controlling means is capable of controlling such that filling is continued from the start of the filling to the end of the filling.

14. The high-speed liquid filling machine according to claim 1,1 or 12, wherein the controlling means is capable of controlling such that the start of the filling is advanced 1° to 90° from an upper dead point of raising and lowering in one raising and lowering cycle of 360°.

15. The high-speed liquid filling machine according to claim 1,1 or 12, wherein the controlling means is capable of controlling such that the distance between a tip of a filling nozzle and a bottom of a container is 20 mm to 70 mm in an upper dead point of raising and lowering.

16. The high-speed liquid filling machine according to claim 1,1 or 12, wherein the controlling means is capable of controlling such that the distance between a liquid surface inside the container and a tip portion of the nozzle is 1 mm to 15 mm when filling in the lowering movement.

17. The high-speed liquid filling machine according to claim 1,1 or 12, wherein the controlling means is a means capable of controlling such that filling is started before the carrying of a container is stopped.

18. The high-speed liquid filling machine according to claim 1,1 or 12, wherein the controlling means is a means capable of controlling such that the start of raising a container is advanced 20° to 50° from the stopping of carrying in one carrying cycle of 360°.

19. The high-speed liquid filling machine according to claim 1,1 or 12, wherein the controlling means is a means capable of controlling such that the carrying is started before the lowering of a container is finished.

20. The high-speed liquid filling machine according to claim 1,1 or 12, wherein the controlling means is a means capable of controlling such that the start of carrying the container is advanced 40° to 70° from the end of lowering in one raising and lowering cycle of 360°.

21. The high-speed liquid filling machine according to claim 1,1 or 12, wherein the control by the controlling means is conducted by changing the setting pulse of a servomotor.

* * * * *